US011753268B2

(12) United States Patent
Yamazaki

(10) Patent No.: US 11,753,268 B2
(45) Date of Patent: Sep. 12, 2023

(54) FINISHING SYSTEM, PIERCING MEMBER ABNORMALITY DETERMINATION DEVICE, AND RECORDING MEDIUM

(71) Applicant: KONICA MINOLTA, INC., Tokyo (JP)

(72) Inventor: Shohei Yamazaki, Kokubunji (JP)

(73) Assignee: KONICA MINOLTA, INC., Tokyo (JP)

( * ) Notice: Subject to any disclaimer, the term of this patent is extended or adjusted under 35 U.S.C. 154(b) by 157 days.

(21) Appl. No.: 17/449,833

(22) Filed: Oct. 4, 2021

(65) Prior Publication Data

US 2022/0112045 A1 Apr. 14, 2022

(30) Foreign Application Priority Data

Oct. 9, 2020 (JP) ..... 2020-170835

(51) Int. Cl.
*B65H 35/00* (2006.01)
*B65H 35/06* (2006.01)

(52) U.S. Cl.
CPC ..... *B65H 35/0093* (2013.01); *B65H 35/06* (2013.01); *B65H 2553/41* (2013.01)

(58) Field of Classification Search
CPC .... B65H 35/00; B65H 35/04; B65H 35/0093; B65H 2553/41; B26F 1/20
USPC ..... 270/52.17, 58.07
See application file for complete search history.

(56) References Cited

U.S. PATENT DOCUMENTS 5,790,168 A * 8/1998 Sano ..... B65H 35/02 347/262
6,914,688 B2 * 7/2005 Inana ..... B65H 35/0066 358/1.12
6,930,802 B2 * 8/2005 Sugaya ..... B65H 20/32 358/1.9
8,181,556 B2 * 5/2012 Brandenburg ..... B65H 23/1882 83/13
8,446,629 B2 * 5/2013 Ishibashi ..... G06F 3/1243 399/385
8,773,738 B2 * 7/2014 Toki ..... B26D 5/28 271/227
9,162,484 B2 * 10/2015 Hoshino ..... B65H 35/0086
9,469,129 B2 * 10/2016 Suzuki ..... B26D 5/32
10,618,190 B2 * 4/2020 Senoo ..... B31F 7/00
11,530,107 B2 * 12/2022 Sugiyama ..... B65H 35/0006
2020/0336605 A1 * 10/2020 Kawasaki ..... H04N 1/00037
(Continued)

FOREIGN PATENT DOCUMENTS

JP 2019195887 A 11/2019
JP 6939038 B2 * 9/2021

OTHER PUBLICATIONS

Machine translation of JP6939038B2; https://translationportal.epo.org/emtp/translate/?ACTION=description-retrieval&COUNTRY=JP&ENGINE=google&FORMAT=docdb&KIND=A&LOCALE=en_EP&NUMBER=2018180228&OPS=ops.epo.org/3.2&SRCLANG=ja&TRGLANG=en (Year: 2018).*

*Primary Examiner* — Leslie A Nicholson, III
(74) *Attorney, Agent, or Firm* — BUCHANAN INGERSOLL & ROONEY PC

(57) ABSTRACT

A finishing system includes a piercing unit, an image reader, and a controller. The piercing unit includes a piercing member that performs piercing processing on a sheet. The image reader reads the sheet on which the piercing processing is performed to acquire a read image. The controller determines abnormality of the piercing member based on the read image.

20 Claims, 9 Drawing Sheets

(56) References Cited

U.S. PATENT DOCUMENTS

| | | | | |
|---|---|---|---|---|
| 2022/0204304 | A1* | 6/2022 | Okada | B65H 35/06 |
| 2022/0380163 | A1* | 12/2022 | Asakawa | B65H 35/04 |

* cited by examiner

FINISHING SYSTEM, PIERCING MEMBER ABNORMALITY DETERMINATION DEVICE, AND RECORDING MEDIUM

BACKGROUND

1. Technical Field

The present invention relates to a finishing system, a piercing member abnormality determination device, and a recording medium.

2. Description of Related Art

As finishing on a sheet on which an image is formed, piercing processing such as perforation processing is performed (for example, JP 2019-195887A).

In such piercing processing, paper dust sometimes clogs grooves of teeth of a piercing member. It obstructs piercing of desired quality. Amounts of paper dust vary depending on characteristics of sheets fed. Amounts of adhering paper dust vary depending on usage environment and the like. It is difficult to predict whether a piercing member is normal or abnormal based on the number of fed sheets and a processing time. Therefore, regular cleaning of a piercing member alone sometimes does not achieve desired quality of piercing.

SUMMARY

An object of the present invention is to detect abnormality of a piercing member at an early stage. The abnormality leads to deterioration in quality of piercing processing.

To achieve the object, according to an aspect of the present invention, a finishing system includes:

a piercing unit including a piercing member that performs piercing processing on a sheet;

an image reader that reads the sheet on which the piercing processing is performed to acquire a read image; and a controller that determines abnormality of the piercing member based on the read image.

According to another aspect of the present invention, a piercing member abnormality determination device includes:

an image acquisition unit that acquires an image by reading a sheet on which piercing processing is performed by a piercing member with an image reader; and a controller that determines abnormality of the piercing member based on the acquired image.

According to still another aspect of the present invention, a non-transitory recording medium stores a program that causes a computer to:

acquire an image by reading a sheet on which piercing processing is performed by a piercing member with an image reader; and determine abnormality of the piercing member based on the acquired image.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, embodiments of the present invention will be described in detail with reference to the drawings. However, the scope of the invention is not limited to the disclosed embodiments.

Configuration of Image Forming System 100

Figure 1:
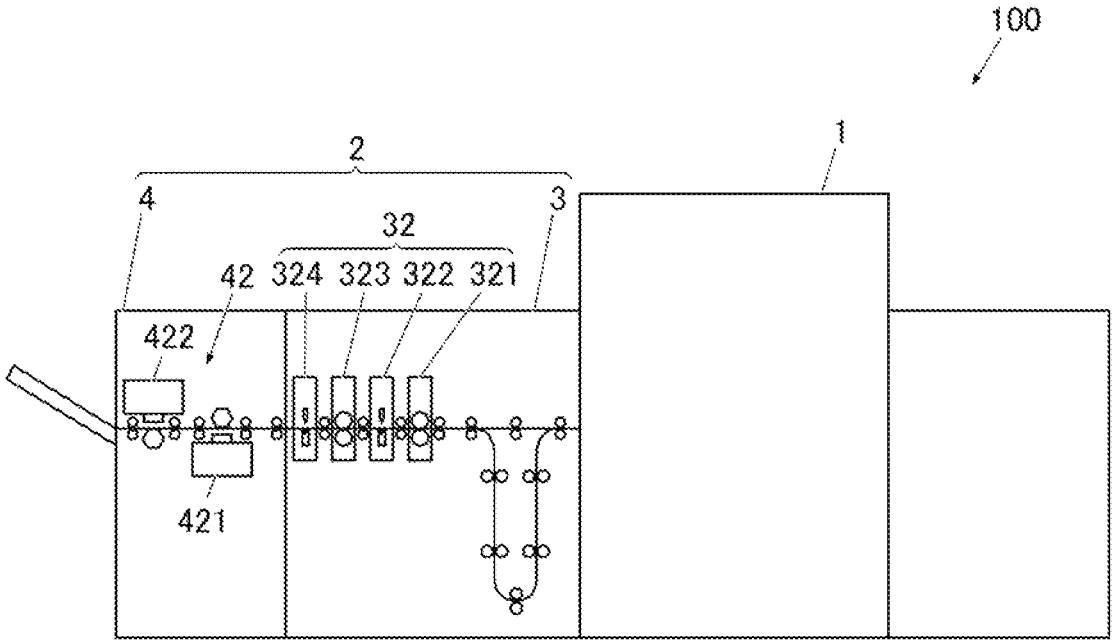
FIG. 1 shows a schematic configuration of an image forming system.
Figure 2:
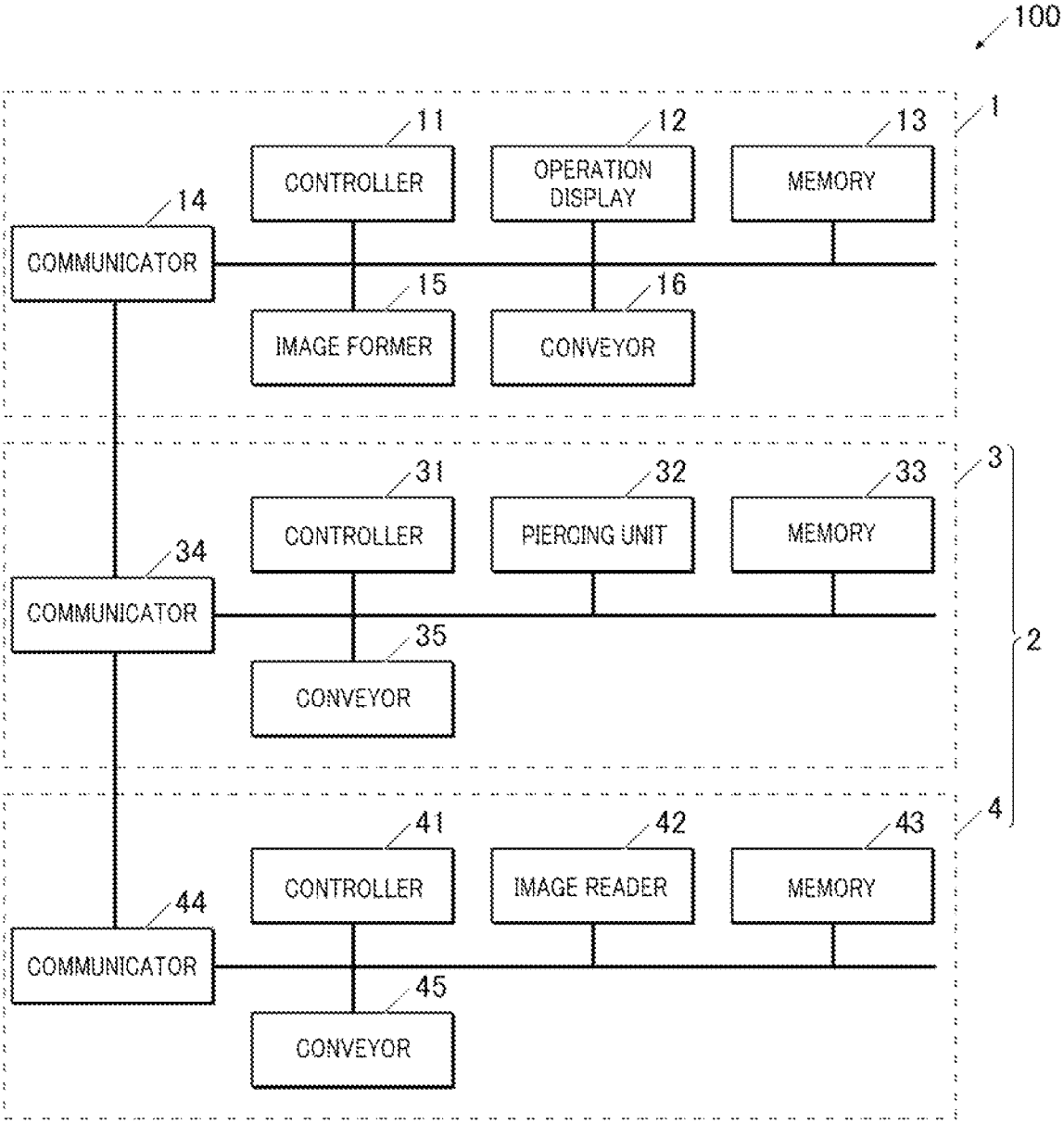
FIG. 2 is a block diagram showing functional configuration of devices constituting the image forming system.

FIG. 1 shows a schematic configuration of an image forming system 100 according to an embodiment. FIG. 2 shows an example of functional configuration of the image forming system 100.

As shown in FIGS. 1-2, the image forming system 100 includes an image forming device 1 and a finishing system 2.

The image forming device 1 forms an image on a sheet S based on input image data. As shown in FIG. 2, the image forming device 1 includes a controller 11, an operation display 12, memory 13, a communicator 14, an image former 15, and a conveyor 16. Each part is connected by a bus.

The controller 11 includes a CPU (central processing unit), ROM (read only memory), and RAM (random access memory). The CPU reads programs stored in the ROM and develops them in the RAM. The CPU comprehensively controls parts of the image forming device 1 according to the developed program.

For example, a print job (hereinafter referred to as a job) is input from an external device, such as a computer, via the communicator 14. The controller 11 transmits image data and setting information of the job to the finishing system 2, and executes the job. The controller 11 makes the conveyor 16 convey a sheet S from a sheet feeder. The controller 11 makes the image former 15 form an image on the sheet S and convey the sheet S, on which the image is formed, to a piercing device 3 of the finishing system 2.

The operation display 12 includes an operation interface and a display. The operation interface includes input devices such as operation keys and a touch panel layered on a screen of the display. The operation interface converts input operation for these input devices into operation signals, and outputs those operation signals to the controller 11. The display 12 includes an LCD (liquid crystal display). The display displays status of the image forming device 1 and the finishing system 2, an operation screen showing contents of input operation on the touch panel, and the like.

The memory 13 includes DRAM (dynamic random access memory) and an HDD (hard disk drive). The memory 13 stores image data, setting information, and the like of jobs input from the outside. The setting information of a job includes a sheet type and sheet size used in the job, image formation conditions such as single/double-sided printing, and information on finishing, such as information on a position of perforation (which is called perforation position information) and information on a position to cut.

The communicator 14 includes a NIC (network interface card) or a serial interface. The communicator 14 transmits/receives data to/from an external computer, devices of the finishing system 2, and the like.

The image former 15 forms an image on a sheet S based on image data of a job stored in the memory 13 under the control of the controller 11. Various methods such as an electrophotographic method and an inkjet method can be adopted as an image forming method of the image former 15.

A sheet S is fed from a sheet feeder (not shown). The conveyor 16 includes sheet conveyance rollers and conveys a sheet S along a predetermined conveyance path. The sheet conveyance rollers convey the sheet S by rotating while sandwiching the sheet S.

The finishing system 2 includes the piercing device 3 and an image reading device 4. The finishing system 2 may further include another finishing device in addition to the piercing device 3 and the image reading device 4. For example, the finishing system 2 may include a cutting device downstream the image reading device 4. The cutting device cuts a sheet S conveyed from the image forming device 1.

The piercing device 3 performs piercing processing on a sheet S conveyed from the image forming device 1. In the embodiment, the piercing device 3 performs perforation processing on a sheet S conveyed from the image forming device 1. That is, the piercing device 3 makes linearly continuous slit-shaped through holes in the sheet S. As shown in FIG. 2, the piercing device 3 includes a controller 31, a piercing unit 32, memory 33, a communicator 34, and a conveyor 35. Each part is connected by a bus.

The controller 31 includes a CPU, ROM, and RAM. The CPU of the controller reads various processing programs stored in the ROM and develops them in the RAM. The CPU comprehensively controls parts of the piercing device 3 according to the developed programs.

For example, the controller 31 receives image data and setting information of pages of a job from the image forming device 1 via the communicator 34. The controller 31 makes the piercing unit 32 perform perforation processing on the sheet S based on perforation position information. The sheet S is conveyed from the image forming device 1. The perforation position information is included in the setting information of the received job. The controller 31 makes the conveyor 35 convey the perforated sheet S to the image reading device 4.

The piercing unit 32 performs piercing processing on the sheet S conveyed from the image forming device 1. As shown in FIG. 1, in the embodiment, the piercing unit 32 includes perforation modules 321-324. The perforation modules 321, 323 form perforations along a conveyance direction (sub-scanning direction) of a sheet S. The perforation modules 322, 324 form perforations along a direction (main scanning direction) orthogonal to the conveyance direction of a sheet S.

The perforation module 321-324 includes:

a perforation teeth roller 50 on a conveyance path through which a sheet S passes;

a rest 60 under the conveyance path of a sheet S; and a moving mechanism (not shown) that moves the perforation teeth roller 50 toward the rest 60.

Figure 3A:
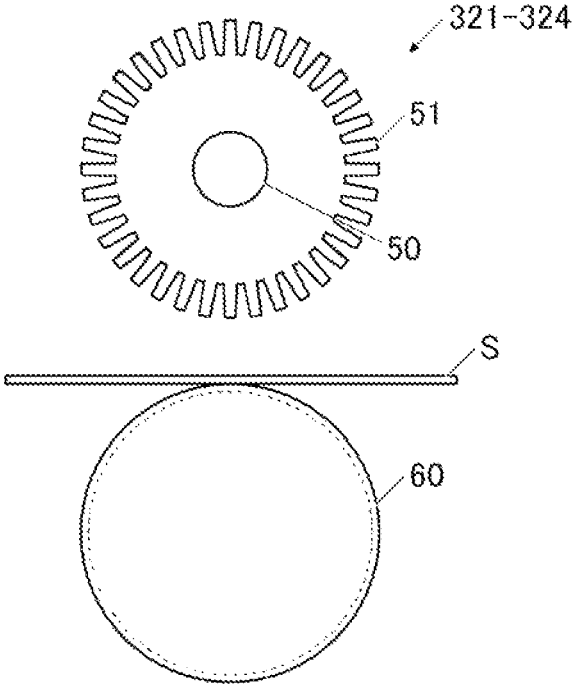
FIG. 3A is a side view of a perforation module. A perforation teeth roller and a rest are separated from a sheet.
Figure 3B:
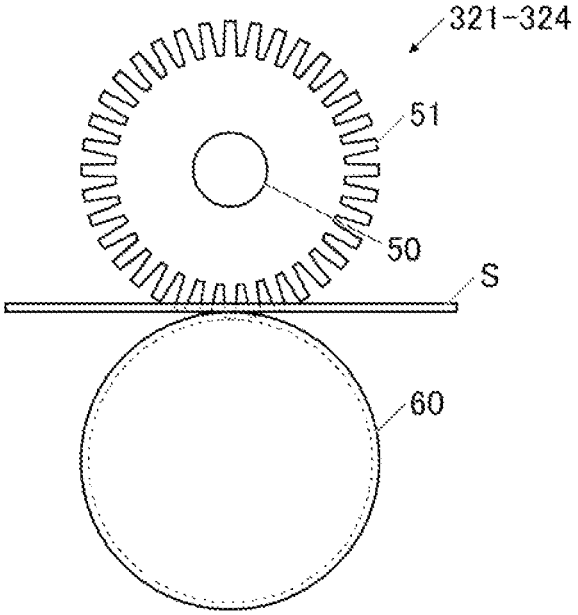
FIG. 3B is a side view of the perforation module. The perforation teeth roller and the rest are in contact with the sheet.
Figure 4:
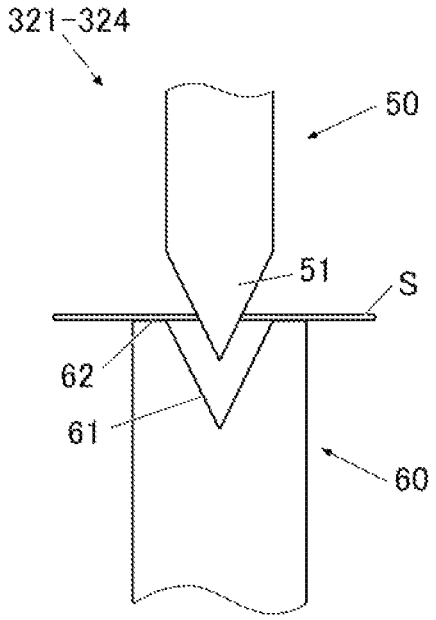
FIG. 4 is a front view of a portion where the perforation teeth roller and the rest are close to each other.

FIG. 3A is a side view of the perforation modules 321-324 in which the perforation teeth roller 50 and the rest 60 are separated from a sheet S. FIG. 3B is a side view of the perforation modules 321-324 in which the perforation teeth roller 50 and the rest 60 are in contact with a sheet S. FIG. 4 is a front view showing a portion of the perforation modules 321-324 in which a perforation tooth 51 of the perforation teeth roller 50 and the rest 60 are close to each other. In the perforation modules 321-324, the perforation tooth 51 is brought into contact with a sheet S, and the sheet S and the perforation tooth 51 of the perforation teeth roller 50 are relatively moved along a surface of the sheet S. Thus, the perforation modules 321-324 perform perforation processing on the sheet S.

The perforation teeth roller 50 perforates a sheet S. The perforation tooth 51 as a piercing member is attached to the perforation teeth roller 50. The perforation teeth 51 are continuously arranged in an annular shape along a circumferential direction of a cylindrical surface of the perforation teeth roller 50. The perforation teeth roller 50 is connected to a driver (not shown), and is rotated by rotation of the driver. In FIGS. 3A-3B, the perforation teeth roller 50 rotates clockwise in a conveyance direction of a sheet S. The sheet S is conveyed from right to left in the figures. The perforation teeth 51 are arranged in an annular shape along a surface of the perforation teeth roller 50. The perforation teeth roller 50 rotates at a position where a cutting edge penetrates a sheet S. Thereby perforations are continuously formed in the sheet S.

The rest 60 is a roller that presses a sheet S against the perforation teeth roller 50. The rest 60 is rotated by a driving force from a driver (not shown). In FIGS. 3A-3B, the rest 60 rotates counterclockwise according to a conveyance direction of a sheet S. The sheet S is conveyed from right to left in the figures.

As shown in FIG. 4, a cylindrical surface of the rest 60 includes:

an outer peripheral surface 62 that comes into contact with a conveyed sheet S; and a groove 61 at the center of the outer peripheral surface 62.

The groove 61 is continuously formed in the center of the outer peripheral surface 62 so that the perforation tooth 51 penetrating the sheet S does not come into direct contact with the cylindrical surface of the rest 60. In the perforation module 321, a sheet S is conveyed onto the outer peripheral surface 62 of the rest 60. A moving mechanism (not shown) moves the perforation teeth roller 50 toward the groove 61 (toward the center of rotation of the rest 60) such that the perforation tooth 51 penetrates the sheet S. Thereby perforation processing can be applied to the sheet S.

The memory 33 is constituted by DRAM, an HDD, or the like, and stores image data, setting information, and the like of jobs.

The communicator 34 is constituted by an NIC, a serial interface, or the like. The communicator 34 transmits/receives data to/from the image forming device 1, devices of the finishing system 2, and the like.

The conveyor 35 includes sheet conveyance rollers, and conveys a sheet S along a predetermined conveyance path.

The image reading device 4 reads a sheet S conveyed from the piercing device 3. Perforation has been applied to the sheet S. The image reading device 4 determines whether the perforation tooth 51 is abnormal based on the read image. As shown in FIG. 2, the image reading device 4 includes a controller 41, an image reader 42, memory 43, a communicator 44, and a conveyor 45. Each part is connected by a bus.

The controller 41 includes a CPU, ROM, and RAM. The CPU of the controller 41 reads programs stored in the ROM and develops them in the RAM. The CPU comprehensively controls parts of the image reading device 4 according to the developed programs.

For example, when the controller 41 receives image data and setting information of pages of a job from the image forming device 1 via the communicator 44, the controller 41 executes abnormality determination processing, which will be described later.

The image reader 42 includes:

a first reader 421 that reads a lower side of a conveyed sheet S; and a second reader 422 that reads the upper side of the conveyed sheet S.

Each of the first reader 421 and the second reader 422 includes a linear image sensor (such as a CCD line sensor), an optical system, and a light source. The first reader 421 and the second reader 422 read a sheet S conveyed from the piercing device 3, and output a read image to the controller 41. The linear image sensor and the light source are arranged such that light emitted from the light source hits the sheet S diagonally and is received by the linear image sensor. Diagonal light irradiation increases a shaded area of a perforated groove and makes a perforation easier to be read.

The memory 43 is constituted by DRAM, an HDD, or the like, and stores image data, setting information, and the like of jobs.

The communicator 44 is constituted by an NIC, a serial interface, or the like. The communicator 44 transmits/receives data to/from the image forming device 1, devices of the finishing system 2, and the like.

The conveyor 45 includes sheet conveyance rollers, and conveys a sheet S along a predetermined conveyance path.

Operation of Finishing System 2

Next, operation of the finishing system 2 will be described.

In the piercing device 3, image data and setting information of pages of a job are received from the image forming device 1. A sheet S on which an image is formed is conveyed from the image forming device 1. Then, the controller 31 makes the piercing unit 32 perform piercing processing on the conveyed sheet S based on the received image data and the perforation position information included in the setting information. Specifically, the controller 31 makes the perforation modules 321-324 perform perforation processing on the sheet S. The conveyor 35 conveys the perforated sheet S to the image reading device 4.

The image reading device 4 receives image data of pages of a job and information on a position where perforation processing is performed (which is called the perforation position information) from the image forming device 1. The perforated sheet S is conveyed from the piercing device 3. Then, the controller 41 executes abnormality determination processing of determining whether the perforation tooth 51 is abnormal.

Figure 5:
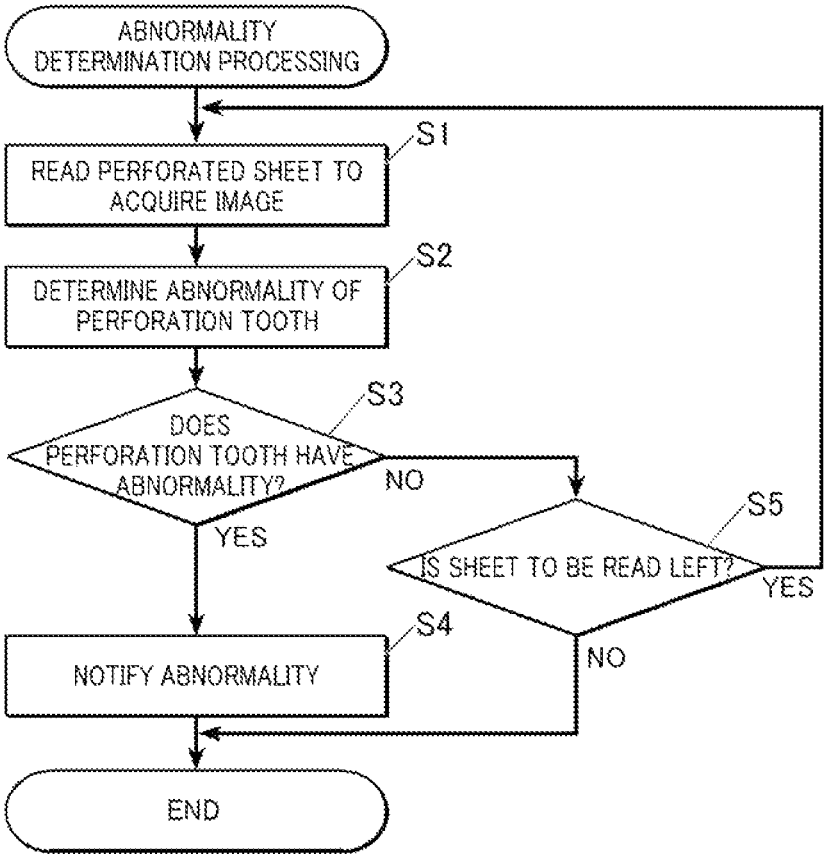
FIG. 5 is a flowchart showing a flow of abnormality determination processing executed by a controller 41 in FIG. 2.

FIG. 5 is a flowchart showing a flow of the abnormality determination processing executed by the controller 41. The CPU of the controller 41 cooperates with programs stored in the ROM to execute the abnormality determination processing.

First, the controller 41 makes the image reader 42 read the perforated and conveyed sheet S to acquire a read image (Step S1).

Next, the controller 41 determines abnormality of the perforation tooth 51 of the perforation teeth roller 50 based on the read image acquired by the image reader 42 (Step S2). The perforation teeth roller 50 is provided in the piercing device 3.

For example, in Step S2, the controller 41 determines abnormality of the perforation tooth 51 based on at least one of a length L and a width W of a perforation, and a space between perforations in the read image.

Figure 6:
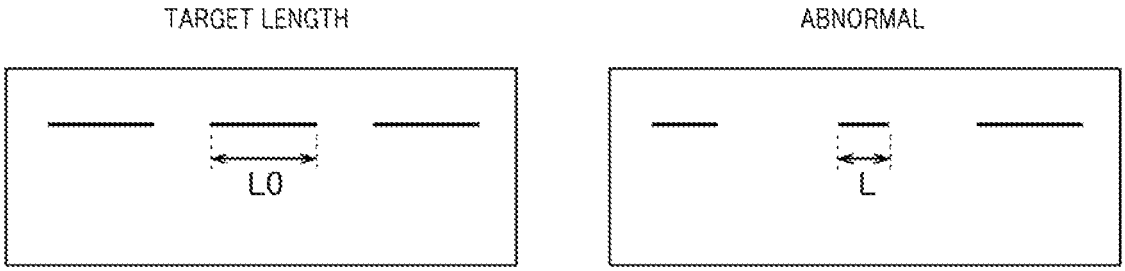
FIG. 6 compares a read image of a perforation having a target length with a read image of a perforation formed by an abnormal perforation tooth.
Figure 7:
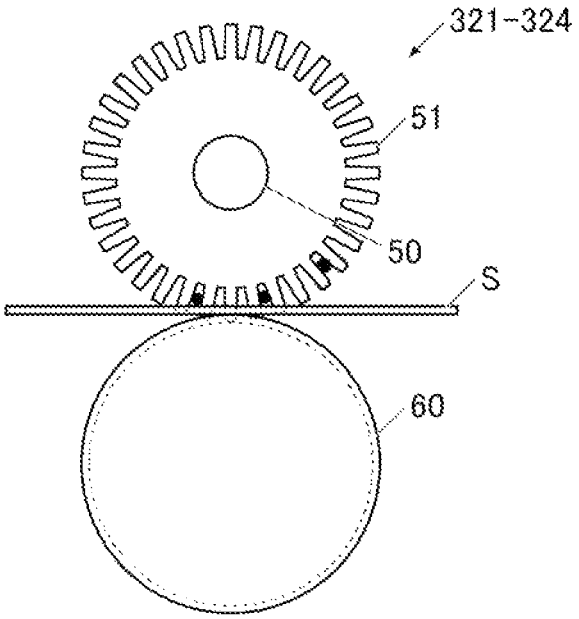
FIG. 7 schematically shows a perforation tooth clogged with paper dust.

FIG. 6 compares a perforation with a target length L0 with a read image of a perforation formed by an abnormal perforation tooth 51. FIG. 7 schematically shows the perforation teeth 51 clogged with paper dust.

As shown in FIG. 6, in the read image, perforations appear blackish like shadows. As shown in FIG. 7, when the perforation teeth 51 is clogged with paper dust, a cutting edge of the clogged portion becomes poor. As shown in FIG. 6, a length L of the perforation formed by a tooth clogged with paper dust is shorter than the predetermined target length L0. A space between perforations is larger at the portion clogged with paper dust. The length L differs between a perforation formed by a tooth at a portion not clogged with paper dust and the perforation formed by the tooth at the portion clogged with paper dust. Thus, perforation lengths L vary. Therefore, in Step S2, the controller 41 measures lengths L of perforations in the read image.

The controller 41 determines that the perforation tooth 51 has abnormality due to paper dust in:

a case where the measured perforation length L is not constant;

a case where the measured perforation length L is shorter than the predetermined target length L0; and a case where a space between perforations is larger than a predetermined space.

Figure 8A:
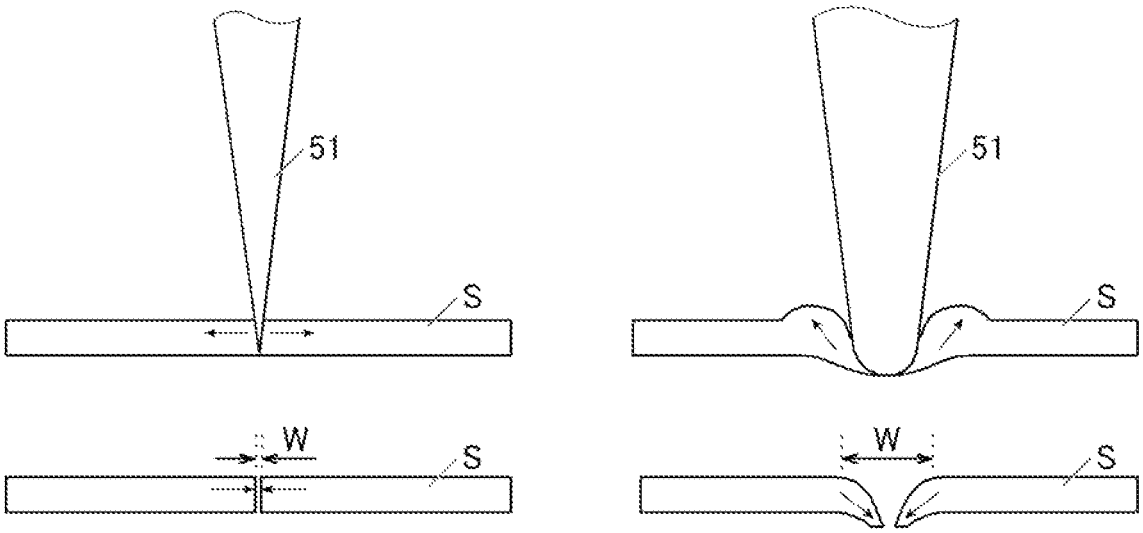
FIG. 8A shows front views of piercing in sheets by old and new perforation teeth, and views showing perforations formed in the sheets.
Figure 8B:
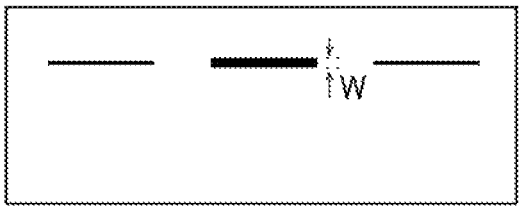
FIG. 8B shows a read image of a perforation formed by an old (weared) perforation tooth.

FIG. 8A shows front views of piercing in sheets S by old and new perforation teeth 51, and views showing perforations formed in the sheets S. FIG. 8B shows a read image of a perforation formed by the old (worn) perforation tooth 51. As shown in FIG. 8A, the perforation tooth 51 collapses when it becomes old and wears. A perforation width W is larger than the perforation formed by the new perforation tooth 51. Therefore, in Step S2, the controller 41 measures a perforation width W from the read image. In a case where the measured perforation width W is equal to or more than a predetermined threshold value, the controller 41 determines that the perforation tooth 51 is worn, that is, it has come to the end of its life.

For example, in a case where the memory 43 stores information about the perforation tooth 51 (perforation tooth information), the controller 41 may determine abnormality of the perforation tooth 51 based on the perforation tooth information and the read image. The perforation tooth information includes at least one of, for example, the number a diameter of the perforation teeth 51, a length (in a rotation direction of the perforation tooth 51) and a width (in a direction orthogonal to the rotation direction of the perforation tooth 51) of the tooth.

For example, the controller 41 estimates a length L of a perforation formed in a sheet S based on:

information on a tooth length in the perforation tooth information; and information on a type (paper type, basis weight) of a sheet S included in the setting information of a job.

In a case where an actual perforation length L measured from the read image is shorter than an estimated length L1, the controller 41 determines that the perforation tooth 51 is abnormal. The estimated length L1 may be the target length L0 of a tooth length L described above.

Similarly, the controller 41 estimates a width W of a perforation formed in a sheet S based on:

information on a width of a tooth in the perforation tooth information; and information on a sheet type included in the setting information of a job.

In a case where a measured actual perforation width W on a sheet S in a read image is larger than an estimated width W1, the controller 41 determines that the perforation tooth 51 is abnormal.

In a case where a measured length L of a perforation in a read image is shorter than the estimated length L1 or a case where a measured perforation width W is larger than the estimated width W1 described above, the controller 41 identifies another perforation formed by the same tooth that formed the corresponding perforation from the read image based on information on the number and the diameter of the perforation teeth 51. A length L and a width W of the identified other perforation may be measured.

The controller 41 determines that the perforation tooth 51 is abnormal in:

a case where the length L of the other perforation is shorter than the estimated length L1; and a case where the width W is larger than the estimated width W1.

In that case, the perforation tooth 51 is not determined as abnormal when formation of a perforation fails just once by accident. It improves accuracy of abnormality determination.

The controller 41 may determine abnormality of the perforation tooth 51 based on:

a read image of an upper side of a sheet S which is acquired by the second reader 422; or a read image of a lower side which is acquired by the first reader 421.

Figure 9:
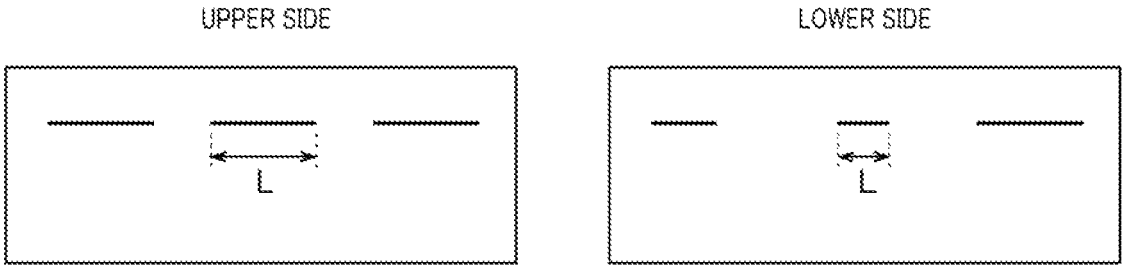
FIG. 9 shows a read image of an upper side of a perforated sheet, and a read image of a lower side.

For example, as shown in FIG. 9, in a case where a length L of one perforation is different between a read image on an upper side and a read image on a lower side, the controller 41 determines that it is abnormality of insufficient piercing due to paper dust accumulated in a groove of the perforation teeth 51.

Figure 10:
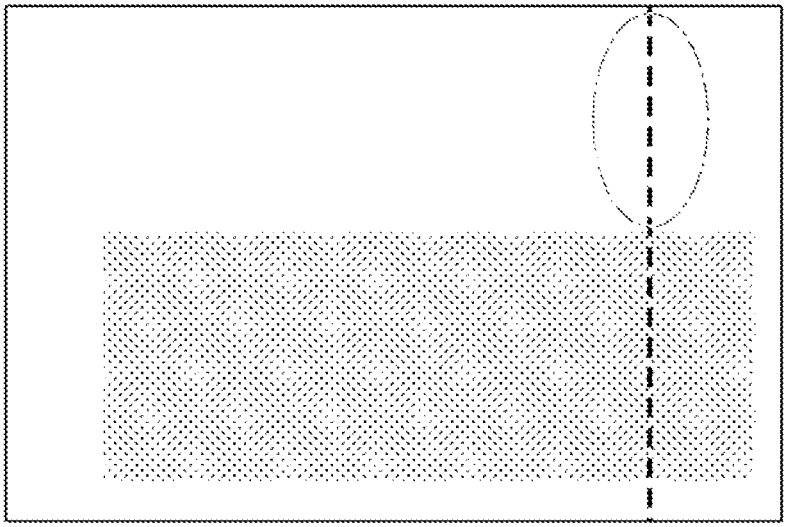
FIG. 10 shows an example of a perforated area used for determining abnormality of a perforation tooth in a case where a printed area on a sheet overlaps a part of the perforated area.
Figure 11:
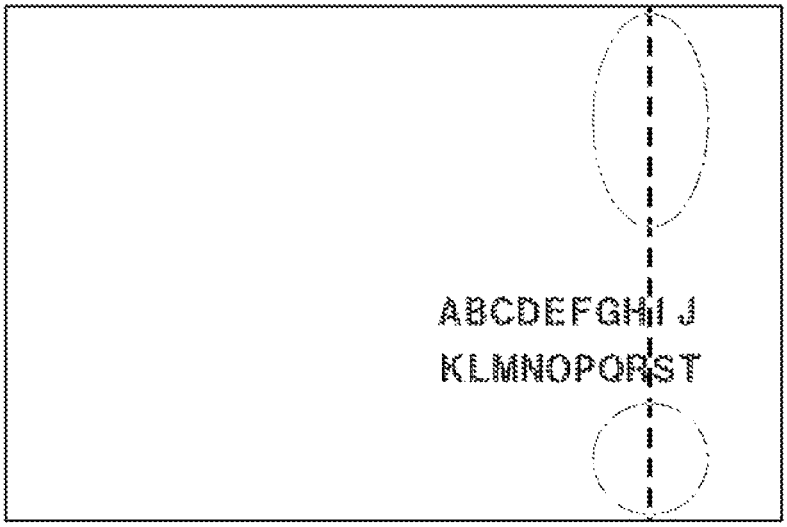
FIG. 11 shows an example of a perforated area used for determining abnormality of a perforation tooth in a case where a printed area on a sheet overlaps a part of the perforated area.

As shown in FIG. 10, in a case where a printed area (image formation area) on a sheet S overlaps a part of a perforated area, the controller 41 identifies a perforated area outside the print area in the sheet S in a read image (for example, the area surrounded by the a dashed line in FIG. 10). The controller 41 determines abnormality of the perforation tooth 51 based on perforations in the identified area. As shown in FIG. 11, lines are thin in a text area and are hard to be distinguished from perforations. Therefore, the controller 41 determines abnormality using perforations in an area where no text is formed in a read image (for example, the area surrounded by a dashed line in FIG. 11). It prevents errors in detection of perforation and improves accuracy of abnormality determination.

Figure 12:
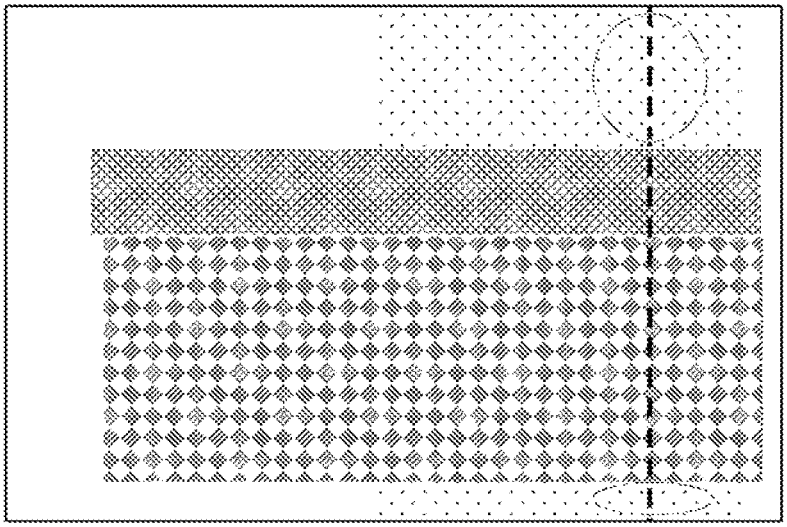
FIG. 12 shows an example of a perforated area used for determining abnormality of a perforation tooth in a case where a printed area on a sheet overlaps a part of the perforated area.

As shown in FIG. 12, in a case where the whole of a perforated area in a sheet S is a printed area, the controller 41 identifies an area of a color where perforations in a read image can be detected base on the perforation position information and image data. The area is, for example, an area of a color where a difference in brightness between the color and perforations is equal to or more than a predetermined threshold value (for example, the area surrounded by a dashed line in FIG. 12). The controller 41 determines abnormality of the perforation tooth 51 based on perforations in the identified area. It prevents errors in detection of perforation and improves accuracy of abnormality determination for the perforation tooth 51.

Figure 13:
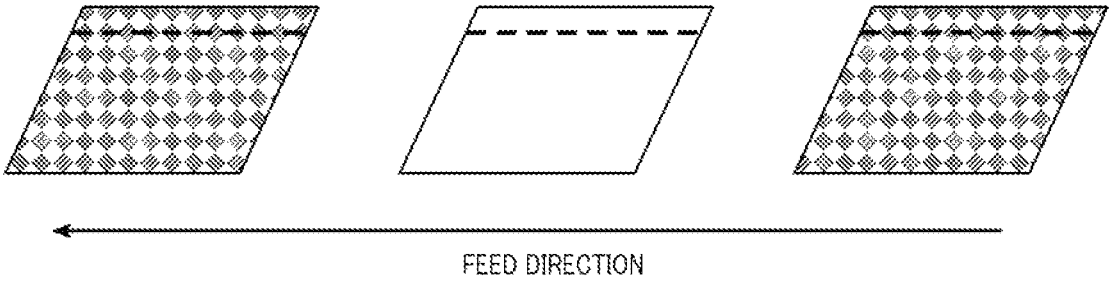
FIG. 13 schematically shows how a blank sheet is fed and abnormality of a perforation tooth is determined.

Alternatively, in the case where the whole of a perforated area in a sheet S is a printed area, the controller 41 may feed a blank sheet between pages of a job as shown in FIG. 13 and make the piercing device 3 perform perforation processing. The image reader 42 reads the blank sheet that has been perforated. The controller 41 determines abnormality of the perforation tooth 51 based on the read image. It prevents errors in detection of perforation and improves accuracy of abnormality determination.

Figure 14:
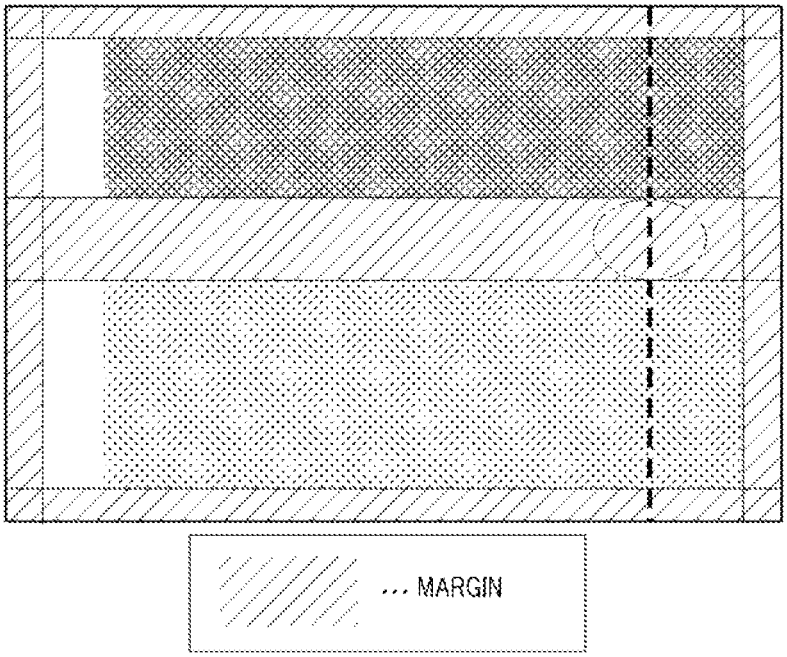
FIG. 14 shows an example of a perforated area used for determining abnormality of a perforation tooth in a case where a printed area on a sheet overlaps a part of the perforated area.

In a case where (i) a cutting device is provided downstream the image reading device 4 in a conveyance direction of a sheet S, (ii) the whole of a perforated area in the sheet S is a printed area, and (iii) the sheet S includes a margin to be cut off as shown in FIG. 14, the piercing device 3 may also perform perforation processing on the margin. The controller 41 determines abnormality of the perforation tooth 51 based on perforations in the margin to be cut off in an image read by the image reader 42. It prevents errors in detection of perforation and improves accuracy of abnormality determination. In a case where there is colored areas in the margin to be cut off, the controller 41 identifies a area where a difference in brightness between a color and perforations is equal to or more than a predetermined threshold value. The controller 41 determines abnormality of the perforation tooth 51 based on perforations in the identified area.

In a case where the controller 41 determines that the perforation tooth 51 has abnormality (YES in Step S3) in determination in Step S2, the controller 41 makes the piercing device 3 stop perforation processing via the communicator 44, and notifies that the perforation tooth 51 needs to be cleaned or replaced (Step S4). The controller 41 ends the abnormality determination processing.

For example, the controller 41 displays a message on the operation display 12 as a notification unit. The message informs that the perforation tooth 51 needs to be cleaned or replaced. In a case where the image forming device 1 includes a voice output, a voice message may be output. The message informs that the perforation tooth 51 needs to be cleaned or replaced. It makes users or engineers aware that the perforation tooth 51 needs to be cleaned or replaced.

On the other hand, in a case where the controller 41 determines that the perforation tooth 51 does not have abnormality (NO in Step S3) in determination in Step S2, the controller 41 determines whether another sheet S to be read is left (Step S5).

In a case where the controller 41 determines that another sheet S to be read is left (YES in Step S5), the controller 41 returns to Step S1.

In a case where the controller 41 determines that another sheet S to be read is not left (NO in Step S5), the controller 41 ends the abnormality determination processing.

Figure 15:
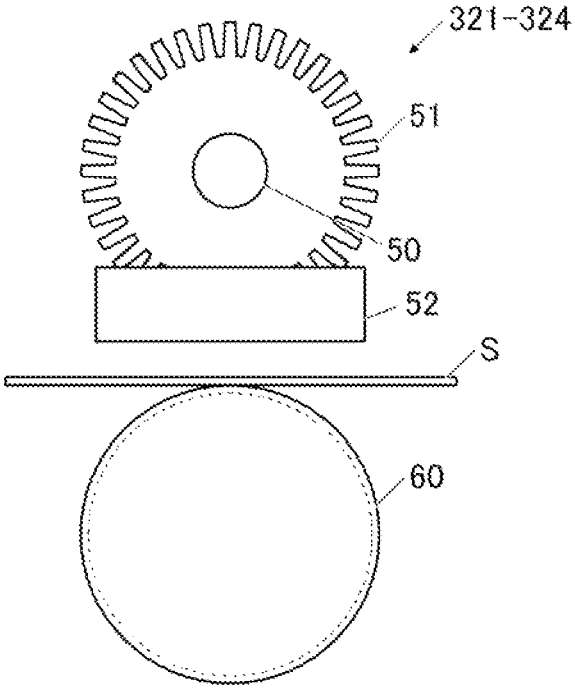
FIG. 15 schematically shows an automatic cleaning mechanism for the perforation tooth.

In the above abnormality determination processing, in a case where the controller 41 determines that the perforation tooth 51 has abnormality, necessity of cleaning the perforation tooth 51 or replacing the tooth is notified in Step S4. The present invention is not limited to this. For example, as shown in FIG. 15, the finishing system 2 may include an automatic cleaning mechanism 52 for the perforation tooth 51. In a case where it is determined that abnormality is due to a paper dust jam, the controller 41 makes the piercing device 3 stop perforation processing via the communicator 44. Then, the controller 41 controls the piercing device 3 such that the automatic cleaning mechanism 52 cleans the perforation tooth 51 automatically. The automatic cleaning mechanism 52 includes, for example, a brush that can be pressed and separated against/from both sides of the perforation tooth 51. In cleaning, the perforation teeth roller 50 is rotated while the perforation tooth 51 and the rest 60 are separated from each other. The brush of the automatic cleaning mechanism 52 is pressed against the perforation tooth 51. Thus the perforation tooth 51 is cleaned. Users do not have to clean the perforation tooth 51. It improves convenience. Both notification and cleaning may be performed.

As described above, according to the finishing system 2, the image reader 42 reads a perforated sheet S to acquire a read image. The controller 41 determines abnormality of the perforation tooth 51 based on the acquired read image. It enables early detection of abnormality of the perforation tooth 51, which deteriorates quality of perforation processing.

The above embodiment is one preferable example of a finishing system according to the present invention. The present invention is not limited to this.

For example, in the above embodiment, the controller 41 of the image reading device 4 acquires an image read by the image reader 42, and determines abnormality of the perforation tooth 51 based on the acquired read image. Thus, the image reading device 4 includes a piercing member abnormality determination device of the present invention. The present invention is not limited to this. For example, the communicator 44 may transmit an image read by the image reader 42 to the image forming device 1 (or the piercing device 3). The controller 11 of the image forming device 1 (or the controller 31 of the piercing device 3) determines abnormality of the perforation tooth 51 based on the read image acquired by the communicator 14 (or the communicator 34). Thus, the image forming device 1 (or the piercing device 3) includes the piercing member abnormality determination device. In that case, the memory 13 (or the memory 33) stores the perforation tooth information. Alternatively, the piercing member abnormality determination device may be independent from the image forming device 1, the piercing device 3, and the image reading device 4. The piercing member abnormality determination device acquires an image read by the image reader 42 via a communicator, and determines abnormality of the perforation tooth 51 based on the acquired read image.

In the above embodiment, the image forming device 1 and the finishing system 2 are separate. Alternatively, the image forming device 1 may include components of the finishing system 2.

In the above embodiment, an image is formed on a sheet based on a print job input from an external device. Abnormality of the piercing member that performs piercing processing on the sheet is determined.

The present invention is also applicable to a case where:

the image forming device 1 includes a document reading device;

a print job is set by the operation display 12 and is based on image data read by the document reading device;

a piercing member performs piercing processing on a sheet on which an image is formed according to the print job; and abnormality of the piercing member is determined.

In the above embodiment, the piercing device 3 performs perforation processing on a sheet S as piercing processing. Abnormality of the perforation tooth 51 as a piercing member is determined. Alternatively, the present invention may be applied to a case where abnormality of a piercing member that performs another piercing processing (for example, punching processing) on a sheet is determined.

In the above embodiment, a sheet on which piercing processing is performed is paper, but the sheet may be made of another material.

In the above example, an HDD or semiconductor memory is used as a computer-readable medium for the program according to the present invention, but the medium is not limited thereto.

Nonvolatile memory such as flash memory, and a portable storage medium such as CD-ROM can also be used as the computer-readable storage medium.

A carrier wave can also be applied to the present invention as a medium for providing data of a program according to the present invention via a communication line.

Details of configuration and operation of the finishing system can also be changed within the scope of the claims.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese patent application No. 2020-170835, filed on Oct. 9, 2020, is incorporated herein by reference in its entirety.

What is claimed is:

1. A finishing system, comprising:

a piercing unit including a piercing member that performs piercing processing on a sheet;

an image reader that reads the sheet on which the piercing processing is performed to acquire a read image; and a controller that determines abnormality of the piercing member based on the read image.

2. The finishing system according to claim 1, wherein the piercing member of the piercing unit is a perforation tooth that perforates the sheet, and the controller determines abnormality of the perforation tooth based on the read image.

3. The finishing system according to claim 2, wherein the controller determines the abnormality of the perforation tooth based on at least one of a length and a width of a perforation, and a space between perforations in the read image.

4. The finishing system according to claim 3, wherein the controller determines that the perforation tooth is abnormal in:

a case where the length of the perforation in the read image is not constant;

a case where the length of the perforation is shorter than a predetermined target length; and a case where the space between the perforations is larger than a predetermined space.

5. The finishing system according to claim 4, wherein the controller determines that the perforation tooth has abnormality due to paper dust in:

the case where the length of the perforation in the read image is not constant;

the case where the length of the perforation is shorter than the predetermined target length; and the case where the space between the perforations is larger than the predetermined space.

6. The finishing system according to claim 3, wherein, in a case where the width of the perforation in the read image is equal to or more than a predetermined threshold value, the controller determines that the perforation tooth is abnormal.

7. The finishing system according to claim 6, wherein, in the case where the width of the perforation in the read image is equal to or more than the predetermined threshold value, the controller determines that the perforation tooth is worn.

8. The finishing system according to claim 2, further comprising:

memory that stores perforation tooth information related to the perforation tooth, wherein the controller determines the abnormality of the perforation tooth based on the perforation tooth information and the read image.

9. The finishing system according to claim 8, wherein the perforation tooth information includes at least one of a number and a diameter of the teeth, and a length and a width of the tooth.

10. The finishing system according to claim 2, wherein the image reader acquires both a read image of an upper side of the sheet and a read image of a lower side of the sheet, and the controller determines the abnormality of the perforation tooth based on the read image of the upper side and the read image of the lower side.

11. The finishing system according to claim 2, wherein the finishing system is connected to an image former that forms an image on the sheet, and in a case where (i) the sheet perforated by the piercing unit is the sheet on which the image is formed by the image former and (ii) an image formation area in the sheet overlaps a portion of a perforated area, the controller identifies perforations in an area of the read image where no image is formed on the sheet, and determines the abnormality of the perforation tooth using the identified perforations.

12. The finishing system according to claim 11, wherein the controller determines the abnormality of the perforation tooth using perforations in an area of the read image where no text is formed on the sheet.

13. The finishing system according to claim 11, wherein in a case where a whole of a perforated area in the sheet is the image formation area, the controller determines the abnormality of the perforation tooth using perforations in an image formation area of one color, and a difference in brightness between the one color and perforations in the read image is equal to or more than a predetermined threshold.

14. The finishing system according to claim 11, wherein in a case where a whole of a perforated area in the sheet is the image formation area, the controller makes the piercing unit perform perforation processing on a blank paper, and determines the abnormality of the perforation tooth based on a read image acquired by reading the perforated blank paper with the image reader.

15. The finishing system according to claim 11, wherein in a case where (i) a whole of a perforated area in the sheet is the image formation area and (ii) the sheet includes a margin to be cut off, the piercing unit performs perforation processing on the margin, and the controller uses perforations in the margin in the sheet in the read image to determine the abnormality of the perforation tooth.

16. The finishing system according to claim 2, further comprising:

an automatic cleaning mechanism for the perforation tooth, wherein, in a case where the controller determines that the perforation tooth has abnormality due to paper dust, the controller stops the piercing unit and makes the automatic cleaning mechanism clean the perforation tooth automatically.

17. The finishing system according to claim 1, wherein, in a case where the controller determines that the perforation tooth has the abnormality, the controller stops the piercing unit and makes a notification unit notify that the perforation tooth needs to be cleaned or replaced.

18. The finishing system according to claim 1, wherein the image reader comprises a light source and a light receiving sensor, and the light source and the light receiving sensor are arranged such that light emitted from the light source hits the sheet diagonally and is received by the light receiving sensor.

19. A piercing member abnormality determination device, comprising:

an image acquisition unit that acquires an image by reading a sheet on which piercing processing is performed by a piercing member with an image reader; and a controller that determines abnormality of the piercing member based on the acquired image.

20. A non-transitory recording medium storing a program that causes a computer to:

acquire an image by reading a sheet on which piercing processing is performed by a piercing member with an image reader; and determine abnormality of the piercing member based on the acquired image.

* * * * *